US005609398A

United States Patent [19]

Warner et al.

[11] Patent Number: 5,609,398

[45] Date of Patent: Mar. 11, 1997

[54] TWISTED STEM ABRADING TOOL AND METHOD OF MAKING

[75] Inventors: Rueben B. Warner; James B. Tyler, both of Westlake, Ohio

[73] Assignee: Jason Incorporated, Cleveland, Ohio

[21] Appl. No.: 326,488

[22] Filed: Oct. 20, 1994

[51] Int. Cl.[6] ..... A46D 1/08

[52] U.S. Cl. ..... 300/21; 300/5

[58] Field of Search ..... 300/21, 7, 8, 5

[56] References Cited

U.S. PATENT DOCUMENTS

| | | | |
|---|---|---|---|
| 2,465,396 | 3/1949 | Peterson et al. | 15/206 |
| 2,580,378 | 12/1951 | Peterson et al. | 300/21 |
| 2,603,921 | 7/1952 | Peterson | 51/186 |
| 2,895,155 | 7/1959 | Peterson | 15/192 |
| 2,972,157 | 2/1961 | Peterson | 15/206 |
| 3,582,140 | 6/1971 | Kaufman et al. | 300/21 |
| 5,464,275 | 11/1995 | Altemare et al. | 300/21 |

*Primary Examiner*—John M. Husar
*Attorney, Agent, or Firm*—Renner, Otto, Boisselle, Sklar

[57] ABSTRACT

A process for forming a twisted stem tool uses a specially designed clamping jaw fixture at the nose or bight portion of a half-round wire or cotter pin which helps to reduce the required clamping force and distribute that force over the entire wire-fill material interface. The jaws of the clamping fixture engage the outside of the nose over a substantial area, and in some forms actually bite into the wire or pin. After the twisting operation, the stem is placed in a swaging or coining press, and the stem beyond the fill material is reformed into a three or six-sided drive stem. The cold flow of the metal to form the flat sides locks the twisted half round wire or pin sections together so that the stem will resist unwinding if the tool is driven in a reverse direction. The coining of the stem providing flats provides a tighter confinement of the bundle of fill material at the stem, and enables a common three or six jaw Jacob's style chuck, for example, to obtain a more secure grip.

15 Claims, 2 Drawing Sheets

TWISTED STEM ABRADING TOOL AND METHOD OF MAKING

DISCLOSURE

This invention relates generally as indicated to twisted stem abrading tools and methods of making such tools, and more particularly to large heavy duty tools useful in honing, abrading and other industrial applications. This invention relates to certain improvements in tools of the type shown in U.S. Pat. No. 4,329,730.

BACKGROUND OF THE INVENTION

Twisted stem tools have been made and used for many years. In twisted stem tools, the bristles or brush material is secured in the bight of a wire or cotter pin with the legs twisted about a common axis. The brush material is then usually disposed in a helix and the projecting twisted stem becomes the drive arbor for powered tools. Such tools find wide application in small size or low torque applications. Examples of such applications would be anything from eyelash applicators to bottle brushes. In fact, the type of tool is often times known as a bottle or tube brush regardless of application.

Bottle or tube brushes are sometimes made with two to four pieces of wire which are held at both ends and then twisted about a common axis resulting in a helical tube or bottle brush. This method then requires a stem on both ends of the brush and one may be used for driving the brush.

Twisted stem tools and their methods of manufacture are shown in the following U.S. patents to Osborn Manufacturing of Cleveland, Ohio:

2,465,396
2,580,378
2,603,921
2,690,631
2,895,155
2,972,157

The advent of abrasive loaded plastic monofilaments and tapes used for abrading and honing tools has created problems in the manufacture of such twisted stem abrading and honing tools. Such monofilaments or tapes are usually made of nylon with a suitable abrasive mixed therein homogeneously. The monofilaments may be round or rectangular. Examples of rectangular nylon monofilaments and twisted stem tools made therefrom are seen in the above noted Schieder et al. U.S. Pat. No. 5,329,730. Examples of tapes are shown in Tyler et al. U.S. Pat. Nos. 5,129,197 and 5,155,945.

Usually, the more filaments or tapes in the bundle which can be secured by the stem, the more effective and aggressive the tool. However, this also creates problems in making twisted stem tools.

With a large bundle, the stem has to be twisted tight. The material, however, has a compressive strength of only about 8000 psi (563.64 Kg/cm$^2$). Some fill materials such as certain types of wire have compressive strengths of 280,000 psi (19727.3 kg/cm$^2$). However, to get the proper twist, the wire at the bundle has to be gripped tightly to resist the torque of the twist. If the wire is crescent-shaped or even round, stress concentrations may easily result which can damage or fracture the fill material. For this reason, the shape of the wire or cotter pin is important as it bears against the fill material. Points of stress concentration need to be avoided. Accordingly, the chuck gripping the wire or pin at the bight needs a firm grip but at reduced pressure. In this manner, the clamping force during manufacture should not exceed the compressive strength of the fill material.

All of the above creates a further problem, particularly for larger tools, such as tools having stems 0.250 inches (6–7 mm) or more. The problems are accentuated when a large amount of fill material is employed to provide a tough and aggressive abrading action. The bundle when tightly formed tends to separate the legs of the stem and if the tool is rotated in a reverse direction repeatedly the stem may tend to unwind. The stems are typically held in the chuck of a power tool and a common chuck would be a three or six jaw Jacob's style chuck. On half-round cotter pin wire which is twisted, such chucks may give less than adequate purchase, particularly if the tool is repeatedly cycled in reverse which is often the case.

Accordingly, there is a need for a twisted stem tool capable of taking advantage of the fill material of the type mentioned in substantial amounts, and which will perform in aggressive applications, with a long useful life. There is also a need for a method of making such tool.

SUMMARY OF THE INVENTION

In the process, a specially designed clamping fixture at the nose or bight portion of a half-round wire or cotter pin helps to reduce the required clamping force and distribute that force over the entire wire-fill material interface. The configuration of the wire or cotter-pin is such that no stress concentrations are created. The jaws of the clamping fixture engage the outside of the nose over a substantial area, and in some forms actually bite into the wire or pin at one or more locations, thus to resist the torque of the twisting operation, when the stem is gripped and twisted in line.

After the twisting operation, the stem is placed in a swaging or coining press, and the stem beyond the fill material is reformed into a three or six-sided flatted drive stem. The cold flow of the metal to form the flat sides locks the twisted half round wire or pin sections together so that the stem will resist unwinding if the tool is driven in a reverse direction. The coining of the stem providing flats provides a tighter confinement of the bundle of fill material at the stem, and also provides a positive and concentric attachment to the drive mechanism, enabling a common three or six jaw Jacob's style chuck to obtain a more secure purchase.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Referring initially to FIGS. 1 and 3–5 there is illustrated a twisted stem tool shown generally at 20 being made in accordance with the present invention. The tool comprises a bundle of initially parallel monofilaments indicated at 21. The bundle is initially formed into a flat relatively uniform bundle as indicated in FIG. 2 with the working tips of the monofilaments projecting evenly on the each side as seen, for example, at 23 and 24 in FIG. 2. A half round wire or cotter pin is bent around one end of the bundle to form a bight or nose portion indicated at 26. The balance of the cotter pin constitutes the legs 27 and 28 which initially extend generally parallel to each other along the longitudinal axis or center line of the bundle. After the wire is bent around the bundle to clasp the bundle at its mid-point or longitudinal axis, the nose is placed in gripping jaws seen at 30 and 31. The legs are also brought together and held in clamping jaws 32 and 33.

Figure 1:
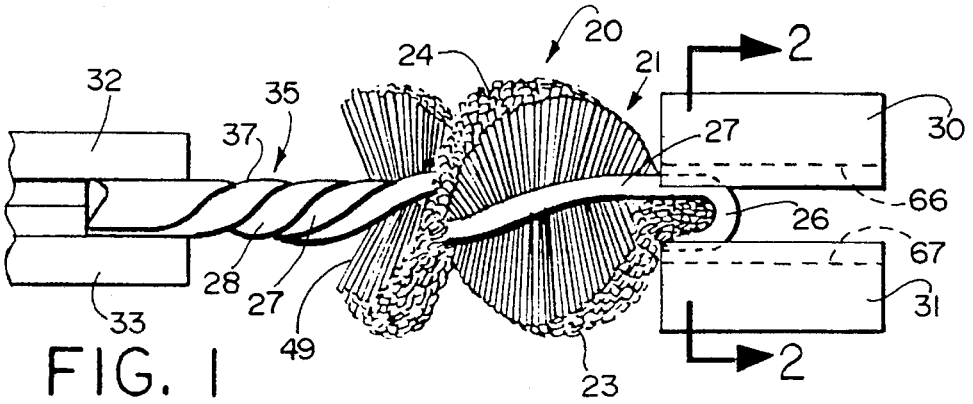
FIG. 1 is a fragmentary side elevation of a twisted stem tool in accordance with the present invention gripped at both ends and twisted.
Figure 2:
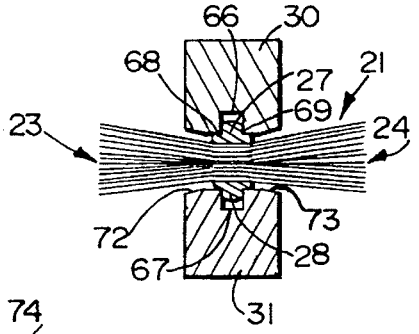
FIG. 2 is a section taken from the line 2—2 of FIG. 1 illustrating a preferred clamping jaw fixture.
Figure 3:
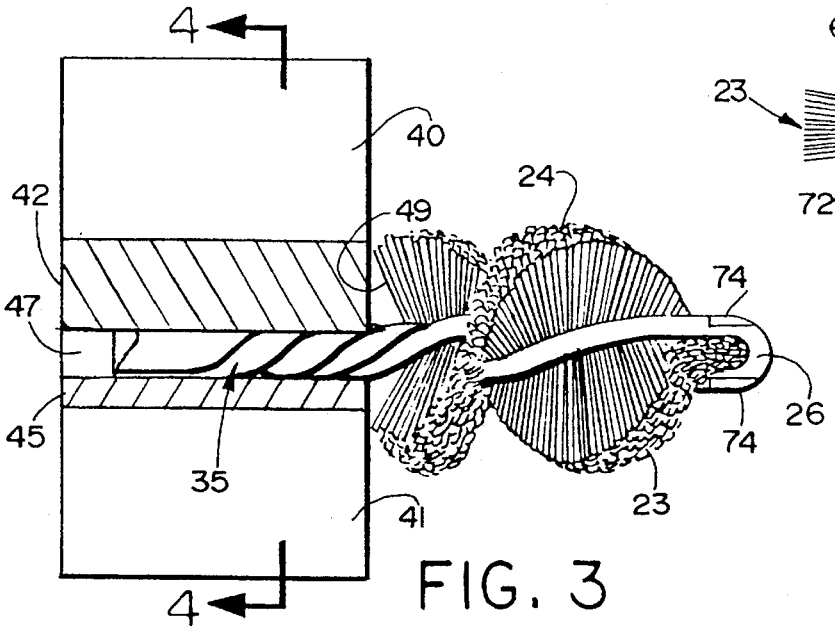
FIG. 3 is a view partially in section showing the tool in the swaging dies.

The clamping jaws 32 and 33 may rotate in a counter-clockwise direction facing to the left in FIG. 1 twisting the legs to form the twisted stem shown generally at 35. The bundle of filament may also convert into a helix but with a lesser helix angle than the stem 35. The twisting of the legs of the cotter pin grasps the bundle of filaments 21 at the axial mid-point and twists that bundle into a helical pattern beyond the nose gripping jaws 30 and 31. As the cotter pin is twisted, it will be appreciated that the jaws 32 and 33 move toward the jaws 30 and 31 but nonetheless maintain the cotter pin under axial tension thus maintaining axial alignment.

After the tool is twisted as seen in FIG. 1, the jaws are opened and the tool is removed. As can be seen in FIG. 1, the profile of the stem has a rather shallow scallop shape configuration indicated at 37 which provides a rough or irregular surface for the gripping jaws of a drive chuck such as a three jaw or six jaw Jacob's chuck.

Figure 4:
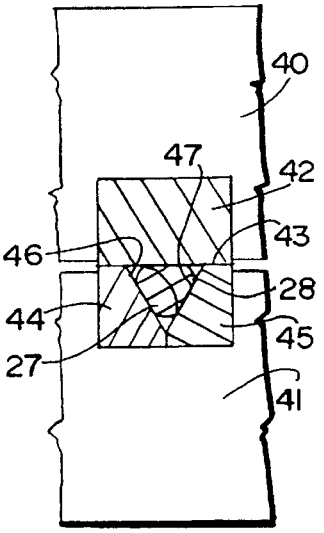
FIG. 4 is a section taken from the line 4—4 of FIG. 3.

After the twisted tool is removed, the tool is then placed in swaging dies 40 and 41. The top swaging die includes a single insert 42 which includes a projecting flat surface 43. The opposite die 41 includes two inserts 44 and 45 which have oppositely inclined diefaces 46 and 47, respectively. When the swaging dies are closed they form an equilateral triangle as illustrated in FIG. 4. The tool is preferably inserted into the swaging dies as far as the other end of the bundle indicated at 49 will allow and the swaging dies are closed. The flatting of the stem as illustrated provides three equally circumferentially spaced flats on the protecting portion of the stem as seen at 51, 52, and 53 in FIG. 6.

Figure 5:
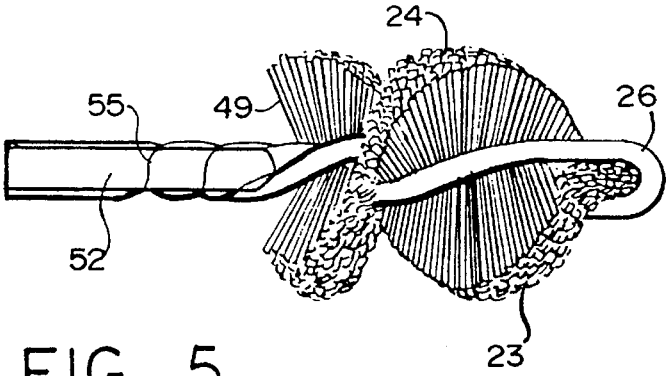
FIG. 5 is a side elevation of the finished tool.
Figure 8:
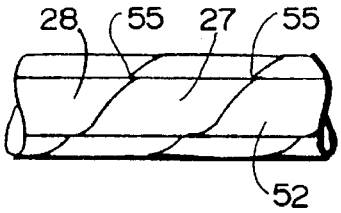
FIG. 8 is a fragmentary side elevation illustrating the distortion interlock of the two parts of the stem when flatted as in FIG. 4.

With reference now to FIGS. 5 and 8 it will be seen that the flatting of the twisted stem not only provides the longitudinal flat extending from the other end of the bundle 49 to the drive end of the stem, but also distorts the helical uniform configuration of the adjoining twisted legs 27 and 28. This distortion is shown at 55 in FIGS. 5 and 8 and such distortion actually causes one leg to overlie slightly the edge of the adjacent leg in effect locking the legs together in their twisted configuration and resisting any tendency for the stem to unwind when driven under high torque in a direction which is reverse that of the twist.

Figure 6:
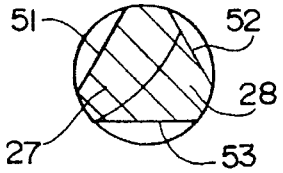
FIG. 6 is an enlarged transverse section of a stem with three flats.

The flats also in the three flat arrangement of FIGS. 4, 5, and 6 create on the stem a flat surface for better purchase or gripping of one of the three equally circumferentially spaced jaws of a typical three-jaw Jacob's chuck.

Figure 7:
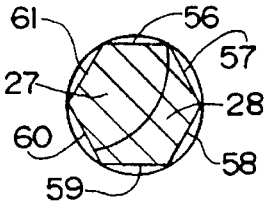
FIG. 7 is a similar view of a stem with six flats.

Another typical jaw arrangement for a Jacob's chuck is six equally spaced jaw members. Better to facilitate the grip of the six-jaw Jacob's chuck, the stem may be provided with six circumferentially equally spaced flats as seen at 56, 57, 58, 59, 60, and 61 in FIG. 7. The six flatted stem may be formed in the same swaging dies with a different half-hexagonal inserts. Accordingly, the secondary flatting step illustrated in FIGS. 3 and 4 not only keeps the stem from unwinding but also provides better purchase for the jaws of a typical Jacob's chuck.

The preferred fill material for the tool of the present invention is nylon monofilaments, either round or rectangular in sectional shape, or nylon tapes, which may be scored or slit to create a plurality of rectangular filaments or fingers. The nylon tape or monofilament is extruded and incorporates therein homogeneously an abrasive. Such fill material is particularly useful in aggressive metal working applications such as deburring or honing, for example. As shown in the prior U.S. patents to Schieder and Tyler mentioned above, while the nylon material is preferred, some other plastics may be employed to form the tool fill material.

Some of the plastics such as the preferred nylon particularly when entrained with abrasive, are partially crystalline and have a limited compressive strength. For example, the compressive strength of the preferred nylon/abrasive material is about 8000 psi (563.64 $Kg/cm^2$) whereas other types of fill materials have much higher compressive strengths. The problem is somewhat accentuated when the thickness of the bundle of monofilaments is relatively substantial as in the illustrated embodiments. For larger size tools where the cotter pin may be on the order of 0.250 inches (6–7 mm) in diameter, it is not possible, in effect to, fold flat the cotter pin at the nose. Thus there has to be some radius of the nose to maintain the strength of the pin at the nose and the thicker bundle makes the pressure upon the fill material more difficult to control. In order to alleviate damage or fracture to the fill material, it is important that the pressure on the nose jaws not exceed the compressive strength of the fill material. It is accordingly important that the interior of the cotter pin not have any projections such as would be present with a crescent-shape cotter pin or with even round wire. The preferred sectional configuration of the cotter pin is such that it is a complete semi-circle having a flat or slightly concave interior surface as seen at 64 in FIG. 9, FIG. 11, and FIGS. 12 and 13. The gripping of the nose of the wire or pin with the fill material therebetween as seen in FIG. 1 must also resist the high torque which is created by the twisting of the stem. Accordingly, on the one hand, too strong a grip will damage the fill material, while too weak of a grip will not properly grasp the nose as the stem is twisted.

To overcome these opposed problems there is provided in FIG. 2 a preferred gripping jaw for the nose which actually bites into the exterior of the wire symmetrically on each side of the center. Each gripping jaw is provided with a longitudinally extending channel as seen at 66 and 67, respectively. The channels provide two sharp interior corners as seen at 68 and 69 which are spaced symmetrically on each side of the center of the wire but considerably more narrow in spacing than the diameter of the wire. The outer edge of each gripping jaw is relieved as seen at 72 and 73.

With the preferred gripping jaws of FIG. 2 the interior corners provided by the center channels bite into the exterior of the half round wire with the corners, in effect pointing to the center of the wire, each at about 45 degrees on opposite sides of the center. This form of nose jaw has been found to be quite effective in obtaining the necessary grip to permit the twist of the stem as seen in FIG. 1 while at the same time avoiding damage to the fill material. The marks provided by the corners are seen at 74 in FIG. 3.

Figure 9:
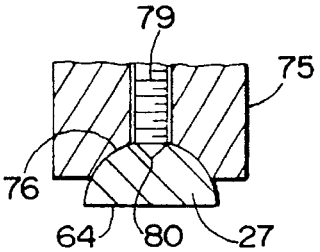
FIG. 9 is an enlarged section of another form of clamping jaw fixture using adjustable teeth.
Figure 10:
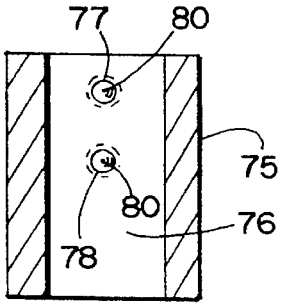
FIG. 10 is a view of the jaw of FIG. 9 from the bottom of such Figure without the wire or pin present.

In FIGS. 9 and 10 there is illustrated an alternative form of nose gripping jaw. The jaw element 75 includes a circular channel 76 adapted to press against the exterior of the wire 27. The jaw channel does not contact the exterior of the wire closer than 25 to 30 degrees from the interior surface 64 centered in the channel 76. Centered in the circular channel 76 are two teeth indicated at 77 and 78 which are in the form of set screws 79 having sharp projecting points 80. The points are designed to bite into the center of the exterior of the wire half 27 and the extent of such penetration can be controlled by simply adjusting the screws.

Figure 11:
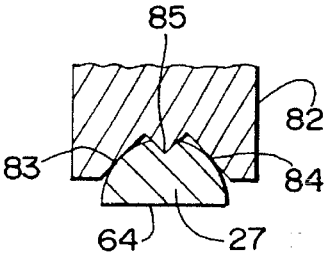
FIG. 11 is a view similar to FIG. 9 of another form of clamping jaw fixture using a fixed tooth.

In FIG. 11 there is illustrated another form of chuck jaw 82 which includes two angular faces 83 and 84. Between the two angular faces is a pointed right angle ridge 85 also designed to bite into the center of the exterior of the half round wire.

Figure 12:
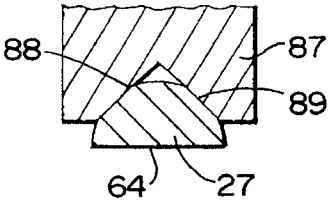
FIG. 12 is a similar view of a clamping jaw fixture using angled flats but no teeth.

In FIG. 12 there is illustrated a gripping jaw 87 which simply has two interior right angle faces 88 and 89 which engage the exterior of the half round wire 27 on opposite sides of the center. The symmetrical flats are designed for somewhat softer wire material and the flat surfaces will deform the circular exterior of the half round wire uniformly distributing the gripping load over the interface 64 between the wire and the fill material.

Figure 13:
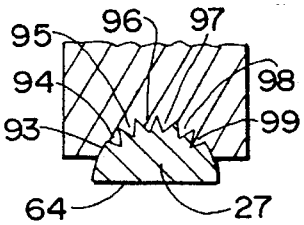
FIG. 13 is a similar view of a clamping jaw fixture using multiple teeth or a sawtooth interior.

In FIG. 13 there is illustrated a gripping jaw 92 which includes a circular channel 93 formed with axially extending striations which form saw teeth 94 through 99, relatively closely spaced. These teeth are designed to bite into the exterior of the half round wire and, while uniformly distributing the gripping load, properly resist the high torque of the twisting operation.

It can now be seen that there is provided a specially designed clamping fixture at the nose or bite portion of a half round wire or cotter pin which helps to reduce the required clamping force and distribute that force over the entire wire-fill material interface. The configuration of the wire or cotter pin is such that no stress concentrations exist and the jaws of the clamping fixture engage the outside of the nose over a substantial area, and in some forms actually bite into the wire or pin at one or more locations thus resisting the torque of the twisting operation.

After the twisting operation the stem is placed in a swaging press and the stem beyond the fill material is reformed into a three or six sided drive stem. The flats provided by the swaging enable a common three or six jaw Jacob's style chuck to obtain a more secure purchase. More importantly, the coining swaging locks the two legs of the stem together so that the stem will not tend to unwind when subjected to high torque operations in a direction of rotation opposite that of the twist.

What is claimed is:

1. A method of making a twisted stem tool comprising the steps of forming a layer bundle of substantially parallel fill material, folding a cotter pin longitudinally around the mid-point of the bundle, the bight portion of the pin enclosing one longitudinal end of the bundle with each leg of the folded pin extending beyond the opposite longitudinal end of the bundle, grasping the pin at the bight portion and the legs beyond the bundle, twisting the legs by relative rotation to form a twisted stem, and then coining the stem to prevent the stem from unwinding when the tool is rotated opposite the direction of the twist.

2. A method as set forth in claim 1 wherein the coining step comprises flattening the stem to cause the twisted parts to interfit in a manner to resist unwinding.

3. A method as set forth in claim 2 wherein said flattening comprises the step of forming a longitudinal flat extending substantially the entire extent of the twisted stem.

4. A method as set forth in claim 3 including at least three flats.

5. A method as set forth in claim 4 including at least six flats.

6. A method as set forth in claim 1 including the step of distributing the grasping pressure at the bight portion over a substantial area to avoid stress concentrations on the fill material.

7. A method as set forth in claim 6 wherein said grasping includes biting into the exterior of the bight portion of the cotter pin.

8. A method as set forth in claim 7 including the step of biting into the bight portion at the center thereof.

9. A method as set forth in claim 8 including the step of biting into the bight portion symmetrically on each side of the center.

10. A method as set forth in claim 9 including the step of biting into the bight portion at a plurality of locations.

11. A method of making a twisted stem tool comprising the steps of forming a flat bundle of parallel filaments of a uniform width and thickness said filaments having a reduced compressive strength, wrapping a half round wire about the center of the bundle by bending it over at one end of the bundle, firmly gripping the bent over end of the wire with generally uniform pressure over the exterior of the half round wire, said uniform pressure being less than the compressive strength of the filaments, gripping the free ends of the wire, and twisting the wire to form a twisted stem projecting from the opposite end of the bundle said gripping including the step of biting into the exterior of the cotter pin to resist the torque of the twisting.

12. A method as set forth in claim 11 including the step of adjusting the extent of the bite.

13. A method as set forth in claim 11 wherein said gripping includes the step of biting into the exterior of the cotter pin symmetrically on each side of the center of the pin.

14. A method as set forth in claim 11 including the step of providing the twisted stem with axially extending flats to resist unwinding of the stem when the tool is driven in a direction of rotation opposite the twist of the stem.

15. A method as set forth in claim 14 wherein said axially extending flats cause the twisted parts of the twisted stem to interfit to resist unwinding when the tool is driven.

* * * * *